United States Patent [19]

Hillert et al.

[11] Patent Number: 4,766,040

[45] Date of Patent: Aug. 23, 1988

[54] TEMPERATURE RESISTANT ABRASIVE POLYCRYSTALLINE DIAMOND BODIES

[75] Inventors: Lars H. Hillert, Nacka; Mats G. Waldenström, Bromma, both of Sweden

[73] Assignee: Sandvik Aktiebolag, Sandviken, Sweden

[21] Appl. No.: 66,478

[22] Filed: Jun. 26, 1987

[51] Int. Cl.[4] ..... B22F 3/00

[52] U.S. Cl. ..... 428/552; 75/230; 75/243; 419/11; 428/408; 428/200; 428/622; 428/634; 428/220

[58] Field of Search ..... 428/552, 408, 634, 622, 428/220; 75/230, 243; 419/11

[56] References Cited

U.S. PATENT DOCUMENTS

| | | | |
|---|---|---|---|
| Re. 32,380 | 3/1987 | Wentorf, Jr. et al. | 407/119 |
| 2,941,248 | 6/1960 | Hall | 18/16.5 |
| 3,136,615 | 6/1964 | Bovenkerk et al. | 51/307 |
| 3,141,746 | 7/1964 | De Lai | 51/307 |
| 3,233,988 | 2/1966 | Wentorf et al. | 51/307 |
| 3,239,321 | 3/1966 | Blainey et al. | 51/309 |
| 3,407,445 | 10/1968 | Strong | 18/34 |
| 3,745,623 | 7/1973 | Wentorf, Jr. et al. | 29/95 |
| 3,767,371 | 10/1973 | Wentorf, Jr. et al. | 51/307 |
| 3,912,500 | 10/1975 | Vereschagin et al. | 125/39 |
| 4,063,909 | 12/1977 | Mitchell | 51/309 |
| 4,108,614 | 8/1978 | Mitchell | 51/295 |
| 4,124,401 | 11/1978 | Lee et al. | 106/44 |
| 4,151,686 | 5/1979 | Lee et al. | 51/307 |
| 4,167,399 | 9/1979 | Lee et al. | 51/307 |
| 4,228,942 | 10/1980 | Dietrich | 228/121 |
| 4,229,186 | 10/1980 | Wilson | 51/297 |
| 4,241,135 | 12/1980 | Lee et al. | 428/332 |
| 4,293,618 | 10/1981 | Hara et al. | 428/551 |
| 4,311,490 | 1/1982 | Bovenkerk et al. | 51/307 |
| 4,403,015 | 9/1983 | Nakai et al. | 428/565 |
| 4,411,672 | 10/1983 | Ishizuka | 51/309 |
| 4,604,106 | 8/1986 | Hall et al. | 51/293 |
| 4,686,080 | 8/1987 | Hara et al. | 419/8 |
| 4,695,321 | 9/1987 | Akashi et al. | 428/552 |

FOREIGN PATENT DOCUMENTS 56-208 1/1981 Japan .

*Primary Examiner*—Stephen J. Lechert, Jr.

*Attorney, Agent, or Firm*—Burns, Doane, Swecker & Mathis

[57] ABSTRACT

Temperature resistant abrasive polycrystalline diamond bodies are described, intended for use as tools in various mechanical operations like turning, milling, drilling, sawing and drawing, having different additions, i.e. amount and composition, of binding, fluxing, catalyst metals at different distances from the working surface. Preferably the metal concentration of the polycrystalline diamond body is decreasing towards the working surface while the metal composition is varied in a way that gives a mechanically stiffer matrix that also has a lower thermal expansion.

In one embodiment the diamond body is high pressure-high temperature-bonded to a supporting body, e.g. of cemented carbide, in order to facilitate the clamping of the tool. In another embodiment the diamond body is brazed to a supporting body or used in a surface-set rock drill bit, i.e. held by a braze metal. Especially good results have been obtained if the hard polycrystalline diamond body comprises three different homogeneous diamond layers on top of each other, each layer having its special amount and composition of relatively low-melting binding metal. These three diamond layers are bonded to each other and to the supporting body, if any, by using intermediate layers of the thickness 3–300 μm, consisting of more high-melting metals or other materials like nitrides or borides, etc. in order to lock in the low-melting binding metals and to prevent diffusion of these metals between the different diamond layers and between the supporting body and the nearest diamond layer.

21 Claims, 1 Drawing Sheet

TEMPERATURE RESISTANT ABRASIVE POLYCRYSTALLINE DIAMOND BODIES

BACKGROUND OF THE INVENTION

This invention relates to wear and temperature resistant polycrystalline diamond bodies for use as tools in cutting, machining and drilling operations and as wear surfaces.

On the market there already exists a number of different high pressure-high temperature sintered tools containing polycrystalline diamond as the main ingredient. These tools are produced in different countries like USA, Japan, Ireland, Sweden, France, USSR, South Africa, etc. and are used for different purposes, among which the most important ones are rotating rock drilling (oil drilling), metal cutting and wire drawing.

The technique when producing such polycrystalline diamond tools using high pressure-high temperature (HP/HT) has been described in a number of old patents, e.g.:

U.S. Pat. No. 2,941,248: "High temperature high pressure apparatus"

U.S. Pat. No. 3,141,746: "Diamond compact abrasive": High pressure bonded body having more than 50 vol % diamond and a metal binder: Co, Ni, Ti, Cr, Mn, Ta etc. causing "interlocking of diamond-to-diamond interfaces". Without any supporting body.

U.S. Pat. No. 3,239,321: "Diamond abrasive particles in a metal matrix": High pressure sintering of diamond together with different metals. Without any supporting body.

U.S. Pat. No. 3,407,445: Process and apparatus for the production of polycrystalline diamond bodies. Without any supporting body.

All these patents disclose the use of a pressure and a temperature during the sintering where diamond is the stable phase. Tools are described having more than 50 vol % diamond and a binder metal, e.g. Co or Ni, but without any supporting body.

In some later patents: e.g. U.S. Pat. Nos. 3,745,623 and 3,767,371 high pressure-high temperature sintered polycrystalline diamond tools are described where the superhard body, containing more than 70 vol % diamond, is bonded to a disk of cemented carbide: "said diamond crystalline material and said cemented carbide being joined at an interface, said interface consisting solely of cemented carbide and diamond crystals".

The patent U.S. Pat. No. 4,311,490 describes a high pressure-high temperature sintered body comprising at least two layers of diamond (or cBN) on top of each other and bonded to a disk of cemented carbide. The diamond grain size of the top layer is below 10 μm and of the bottom layer below 70–500 μm. In this case, too, the condition is that the amount of diamond (cBN) is more than 70 vol % and that the diamond (cBN) grains in the bottom layer lie in direct contact with the sintered carbide of the supporting disk. Still another condition is that the diamond (cBN) grains are directly bonded to each other and that the hard layers, apart from diamond (cBN), only contain metals.

The patent U.S. Pat. No. 4,403,015 describes the use of nonmetallic intermediate layers consisting of cubic boron nitride (below 70 vol %) and one or more carbides, nitrides, carbonitrides or borides between the superhard polycrystalline diamond layer and the support disk.

A number of other patents describe the use of metallic intermediate layers between the diamond (cBN) layer and the supporting disk. e.g.:

U.S. Pat. No. 4,063,909: "Abrasive compact brazed to a backing": an intermediate layer, <0.5 mm thick, of Ti, Cr, Mn, V, Mo, Pt, Fe, Co, Ni, etc. HP/HT sintered.

U.S. Pat. No. 4,108,614: "Zirconium layer for bonding diamond compact to cemented carbide backing". HP/HT sintered.

U.S. Pat. No. 4,228,942: "Method of producing abrasive compacts": Ti and Ag-Cu-Zn-Ni-Mn brazed at 750° C.

U.S. Pat. No. 4,229,186: "Abrasive bodies": A laminated abrasive body which is in effect a thick compact comprising a plurality of diamond compacts laminated together, joining of adjacent compacts taking place by means of a layer of metal, e.g. 100 μm Zr, or a metal alloy braze and the thickness of the laminate exceeding 5 mm. Each diamond body consists of 80 vol % diamond and 20 vol % of metal, e.g. Co.

U.S. Pat. No. 4,293,618: "Sintered body for use in a cutting tool and the method for producing the same". The supporting disk is here (Mo,W)C+Co. In some of the examples an intermediate layer of a metal, e.g. Mo, W, Nb, Ta, Ti, Zr or Hf is used between the supporting disk and the hard body of diamond or cubic boron nitride.

U.S. Pat. No. 4,411,672: "Method for producing composite of diamond and cemented tungsten carbide". Between the diamond powder and the supporting disk of (WC+Co) an intermediate layer of a metal, e.g. Co—Ni—Fe—alloy, having a metal point lower than the eutectic point of the WC—Co—composition is used. The sintering is made at a temperature where the Co—Ni—Fe—alloy melts but not the (WC+Co) disk.

The patent U.S. Pat. No. 4,604,106: "Composite polycrystalline diamond compact" describes the use of small presintered pieces of cemented carbide as an addition of the diamond grains giving a higher diamond concentration towards the working surface and a lower concentration towards the supporting disk.

In most practical cases the working surface of the polycrystalline diamond body, coming into contact with the work piece, ought to have the highest possible wear resistance and thermal stability. the other side of the diamond body, however, ought to be less rigid or brittle in order to be able to withstand the forces of the clamping without cracking. This is valid for all types of clamping, but the crack tendency is higher in the case where the diamond body is HP—HT—bonded directly to a support of e.g. cemented carbide and the difference in thermal expansion and mechanical properties is great and sharp between the diamond body and the support material.

In order to improve the temperature resistance of polycrystalline diamond tools two different ways have been attempted. Both ways aim at decreasing the thermal expansion of the diamond layer. One method is, according to the patents U.S. Pat. Nos. 3,233,988 and 3,136,615, to use relatively great amounts of binder metals e.g. Co, during the sintering and afterwards leach out the metals by using strong acids, giving a porous and mechanically weaker material. The other method is to put in materials with low thermal expansion like Si, Si—alloys and SiC into the diamond body according to the patents U.S. Pat. Nos. 4,151,686, 4,241,135, 4,167,399 and 4,124,401.

Neither of these known methods, however, solve the problem of giving optimum properties to both the working surface of the polycrystalline diamond tool and the opposite part of the diamond body close to the support material like a disk of cemented carbide or a braze metal or another type of clamping.

SUMMARY OF THE INVENTION

Experiments have now shown that it is possible to solve these problems by using different amounts and different kinds of binding catalyst metals in different parts of the polycrystalline diamond body. This can for instance be achieved by using two or more, preferably three, different homogeneous diamond layers on top of each other, each layer having its special amount and composition of relatively low-melting binding metal. These three diamond layers are bonded to each other and to the support body, if any, by using intermediate layers of the thickness 3-300 μm, comprising more high-melting metals or other materials like nitrides or borides, etc in order to lock in the low-melting binding metals and to prevent diffusion of these metals between the different diamond layers and between the supporting body, if any, and the nearest diamond layer.

When sintering the described abrasive polycrystalline diamond bodies such as combination of high pressure and high temperature is used where diamond is stable.

By changing the amount and composition of the binding catalyst metal of each layer independent of the other layers it is not possible to influence a number of important properties of each layer and thus optimize each of the layers according to their different function.

Thus, increasing of the amount of binding metal will increase the toughness and elasticity of the diamond layer and increase the thermal conductivity. On the other hand decreasing of the metal content will give a better thermal stability due to a lower thermal expansion of the diamond - metal body and a decreased tendency of the diamond to form graphite and will also improve the wear resistance. Furthermore a changing of the composition of the metal can also influence both the toughness and the thermal expansion because of the different mechanical properties and thermal expansion of different metals and alloys.

A suitable choice of the amount and type of metal in the top diamond layer will give this "working surface" the very best properties when wearing or cutting against the work material.

In a corresponding way a suitable choice of the amount and type of metal in the bottom diamond layer will optimize this layer against the support, whether it is a HP—HT—bonded or brazed disk of cemented carbide or just a braze or a mechanical clamping.

It has further been found that the mechanical and thermal strength of the tool can be improved if a third diamond layer is used. This layer is put between the two layers mentioned above and its purpose is to bring about a strong bond between the two other layers that have different properties because of different amount and composition of the binding metals. By a suitable choice of metals this central diamond layer can be given properties that lie between those of the two other surrounding diamond layers.

It has further been found that still another improvement of the performance of the diamond tool can be obtained by adjusting the thickness of each layer.

According to the invention temperature resistance abrasive polycrystalline diamond bodies are provided, intended for use as tools in various mechanical operations like turning, milling, drilling, sawing and drawing, having different additions, i.e. amount and composition, of binding, fluxing, catalyst metals at different distances from the working surface. Preferably the metal concentration of the polycrystalline diamond body is decreased towards the working surface, while the metal composition is varied in a way that gives a mechanically stiffer matrix that also has a lower thermal expansion.

In one embodiment the diamond body is HP—HT—bonded to a supporting body, e.g. of cemented carbide, in order to facilitate the clamping of the tool. In another embodiment the diamond body is brazed to a supporting body or used in a surface-set rock drill bit, i.e. held by a braze metal.

According to the invention the amount and type of binding metals can be chosen in order to give the tool properties that fit into a specified field of application, i.e. mechanical operation.

The suitable binding metal ought to have a relatively low melting point and can be one of the following or alloys between them: Co, Ni, Fe, Mn, Si, Al, Mg, Cu and Sn, etc. in amounts between 1 and 40 volume %, preferably 3-20 volume %.

Especially good results have been obtained if the hard polycrystalline diamond body consists of three different homogeneous diamond layers on top of each other, each layer having its special amount and composition of relatively low-melting binding metal.

BRIEF DESCRIPTION OF THE DRAWINGS

Diamond tool consisting of three superhard layers and a supporting disk is shown schematically in FIG. 1, where

11=top layer or working surface
12=central layer
13=bottom layer
14=supporting material, e.g. a disk of sintered carbide like WC+Co
21,22 and 23=intermediate layers
$t_1$,$t_2$,$t_3$=thickness of the superhard layers

DETAILED DESCRIPTION

Figure 1:
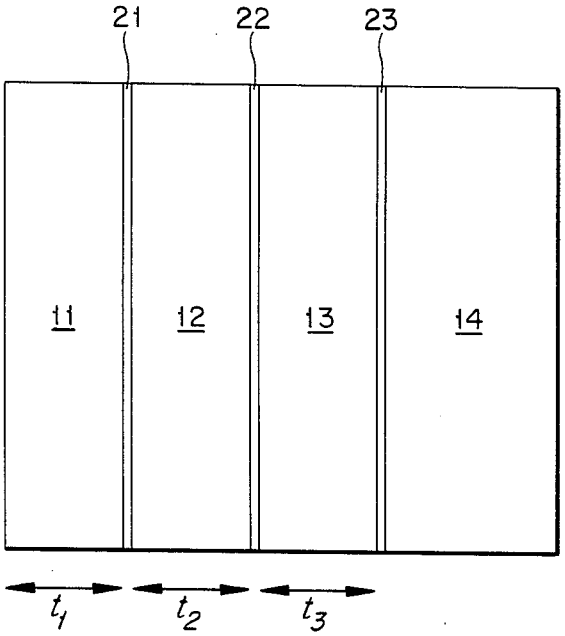

The top layer (11) is given such a metal content, metal composition and thickness that a maximum wear resistance is achieved in a specified field of application, i.e. mechanical operation with its demand for toughness behaviour, impact strength, temperature resistance, etc. As a rule the metal content is lower in the top layer.

The bottom layer (13) is given such a metal content, metal composition and thickness that a sufficiently strong bond is achieved to the supporting disk in order to cope with the mechanical and thermal stresses in the specified field of application, i.e. mechanical operation in question. As a rule the metal content is higher in the bottom layer.

The central layer (12) (if three superhard layers are used) is given such a metal content, metal composition and thickness that it can bond together the top layer and the bottom layer so efficiently that the connection can cope with the mechanical and thermal stresses in the specified field of application, i.e. mechanical operation in question.

In order to keep the three superhard layers separated from each other during the production and to prevent diffusion of metals between these layers and between the supporting disk and the bottom layer, thin intermediate layers (21,22 and 23) are used, consisting of relatively high melting metals or alloys or other materials except diamond and cubic boron nitride, having a thickness between 1 and 300 μm, preferably 3–150 μm, e.g. Mo, W, Zr, Ti, Nb, Ta, Cr, V, $B_4C$, $TiB_2$, SiC, ZrC, WC, TiN, TaN, $ZrB_2$, ZrN, TiC, (Ta,Nb)C, Cr-carbides, AlN, $Si_3N_4$, $AlB_2$ etc. As intermediate layers 21 and 22 metal foils are generally used while the intermediate layer (23) towards the supporting disk (14) can be applied in different ways, e.g. by using metal foils or powder of metals or other materials or using PVD- or CVD-methods, e.g. W or TiN. When using PVD- or CVD-methods a thickness of at least 3 μm is used and preferably 5–20 μm.

It has been shown that the intermediate layers, 21, 22 and 23, are necessary to use as a diffusion barrier in order to prevent the binding catalyst metals to diffuse between the three superhard layers (11, 12 and 13) or from the supporting disk (14) to the bottom superhard layer (13). Experiments that have been made in order to give the three superhard layers 11, 12 and 13 different metal contents without blocking the metal diffusion using barrier layers 21, 22 and 23, have shown a remarkable levelling out of the metal content between the layers (11, 12 and 13) and a diffusion of metal from the supporting disk (14) into the bottom layer (13).

In tools according to the invention the thickness of each of the superhard layers can be adjusted to suit different technical operations. Each layer ought to have a thickness between 0.1 and 2.0 mm, preferably 0.2–0.5 mm, the total thickness being less than 3.0 mm, preferably less than 1.5 mm.

At the same time the three intermediate layers (21,22 and 23) can be adjusted by the choice of material and thickness in order to give the bond between the three super hard layers (11 and 12 and further 12 and 13) and between the super hard bottom layer (13) and the supporting disk (14) a sufficient strength in order to cope with the mechanical and thermal stresses in the specified field of application, i.e. mechanical operation in question. Simultaneously the diffusion of metals is blocked between the super hard layers and between the supporting disk (14) and the super hard bottom layer (13).

The grain size of the diamond can be on different levels beneath 500 μm and is chosen by taking into consideration the technical application of the tool. For certain purposes, for example, the grain size ought to be between 10 and 50 μm and for other purposes between 50 and 300 μm, etc.

Furthermore it has been shown to be especially advantageous for the wear resistance of the tool if part of the diamond, e.g. 5–20%, is microcrystalline, i.e. synthesized by an explosion technique, e.g. Du Ponts method. This type of diamond comprises spherical agglomerates of the size 0.1'60 μm built up by crystalline of the size 70–300 Angstrom.

Besides diamond and different metals the superhard layers contain one or more of the following hard refractory component cubic boron nitride, $B_4C$, $TiB_2$, SiC, ZrC, TiN, ZrB, ZrN, TiC, (Ta,Nb)C, Cr-carbides, AlN, $Si_3N_4$, $AlB_2$ and whiskers of $B_4C$, *SiC*, *TiN*, *Si*$_3$N$_4$ etc.

The supporting material (14) can be chosen according to the following different alternatives.

(a) no supporting disk of all (b) a supporting disk of presintered cemented carbide, e.g. WC+Co, bonded to the diamond body by brazing (c) a supporting disk of other materials than cemented carbide of the type WC+Co, e.g. presintered TiN+Co, $TiB_2$+Co or $Si_3N_4$-based materials, etc. bonded to the diamond body by brazing (d) a supporting disk of presintered cemented carbide, e.g. W+Co+an intermediate layer, bonded to the diamond body by HP—HT.

(e) a supporting disk of other materials than cemented carbide of the type WC+Co, e.g. presintered TiN+Co+an intermediate layer, $TiB_2$+Co+an intermediate layer or $Si_3N_4$-based materials, etc., bonded to the diamond body by HP—HT.

The thickness of the supporting disk ought to be more than 0.2 mm, preferably 1–5 mm.

Tools according to the invention can further be provided with a thin layer, 1–10 μm, of diamond by PVD or CVD.

EXAMPLES

Below a number of examples follow where tools have been made according to the invention with designations according to FIG. 1. In all these cases the following type of supporting disk is used:

WC: 87 weight % and the grain size: 1.8 μm
Co: 13 weight %
total thickness: 3.5 mm
The high pressure—high temperature conditions have been:
Pressure: 60 kbar (=6.0 GPa)
Temperature: 1700° C.
Holding time: 3 minutes

EXAMPLE 1

Tool with the following construction:
11=no one
12=80 vol % diamond (80% 125–150 μm+20% 37–44 μm)+10 vol % WC+10 vol % cobalt
13=80 vol % diamond (80% 125–150 μm+20% 37–44 μm)+20 vol % cobalt
21=no one
22=Mo: 100 μm as foil
23=Mo: 100 μm as foil
$t_1$=no one
$t_2$=0.4 mm
$t_3$=0.4 mm

EXAMPLE 2

Tool with the following construction:
11=90 vol % diamond (10–50 μm)+2 vol % cobalt+8 vol % $B_4C$ (10–50 μm)
12=90 vol % diamond (10–50 μm)+6 vol % cobalt+4 vol % $B_4C$ (10–50 μm)
13=90 vol % diamond (10–50 μm)+10 vol % cobalt
21=Mo: 100 μm as foil
22=Mo: 100 μm as foil
23=TiN: 10 μm as PVD-layer
$t_1$=0.3 mm
$t_2$=0.3 mm
$t_3$=0.4 mm

EXAMPLE 3

Tool with the following construction:
11=80 vol % diamond (10–50 μm)+4 vol % cobalt+16 vol % $B_4C$ (10–50 μm)
12=80 vol % diamond (10–50 μm)+12 vol % cobalt+8 vol % $B_4C$ (10–50 μm)
13=80 vol % diamond (10–50 μm)+18 vol % cobalt+2 vol % $B_4C$ (10–50 μm)
21=Mo: 100 μm as foil
22=Mo: 100 μm as foil 23=TiN: 10 μm as PVD-layer
$t_1$=0.3 mm
$t_2$=0.3 mm
$t_3$=0.4 mm

EXAMPLE 4

Tool with the following construction:

11=70 vol % diamond (10–50 μm)+10 vol % diamond (15 μm agglomerates and 70–300 Angstrom crystallites)+4 vol % cobalt+16 vol % $B_4C$ (10–50 μm)

12=70 vol % diamond (10–50 μm)+10 vol % diamond (15 μm agglomerates and 70–300 Angstrom crystallites)+12 vol % cobalt+80 vol % $B_4C$ (10–50 μm)

13=70 vol % diamond (10–50 μm)+10 vol % diamond (15 μm agglomerates and 70–300 Angstrom crystallites)+18 vol % cobalt+2 vol % $B_4C$ (10–50 μm)

21=Mo: 100 μm as foil
22=Mo: 100 μm as foil
23=TiN: 10 μm as PVD-layer
$t_1$=0.3 mm
$t_2$=0.3 mm
$t_3$=0.4 mm

EXAMPLE 5

Tool with the following construction:

11=70 vol % diamond (10–50 μm)+6 vol % cobalt+24 vol % $B_4C$ (10–50 μm)

12=70 vol % diamond (10–50 μm)+18 vol % cobalt+12 vol % $B_4C$ (10–50 μm)

13=70 vol % diamond (1–50 μm)+25 vol % cobalt+5 vol % $B_4C$ (10–50 μm)

21=Mo: 100 μm as foil
22=Mo: 100 μm as foil
23=TiN: 10 μm as PVD-layer
$t_1$=0.3 mm
$t_2$=0.3 mm
$t_3$=0.4 mm

We claim:

1. A temperature resistance abrasive polycrystalline diamond body wherein the superhard body comprises at least two, different homogeneous diamond layers, on top of each other separated by a metal diffusion-blocking intermediate layer between each said diamond layer, each diamond layer having a thickness of 0.1–2.0 mm but with the total layer thickness being below 3.0 mm, each diamond layer having its special amount and composition of relatively low-melting binder metal in amounts between 1 and 40 vol %, and one or more hard refractory compounds and further wherein the metal-diffusion-blocking intermediate layers each have a thickness between 1 and 300 μm.

2. The polycrystalline diamond body of claim 1 wherein the diamond of the diamond layers is statically made.

3. The polycrystalline diamond body of claim 2 wherein from 5 to 20% of the statically made diamond is replaced by microcrystalline diamond made dynamically using explosives.

4. The polycrystalline diamond body of claim 1 wherein the body comprises three polycrystalline diamond layers.

5. The polycrystalline diamond body of claim 1 wherein the low melting binder metal of each diamond layer is selected from the group consisting of Co, Ni, Fe, Mn, Si, Al, Mg, Cu and Sn.

6. The polycrystalline diamond body of claim 5 wherein the low melting binder metal is present in an amount of from 3 to 20 vol %.

7. The polycrystalline diamond body of claim 1 wherein the metal diffusion—blocking layers comprise relatively high melting point metals, metal alloys or metal compounds other than cubic boron nitride or diamond.

8. The polycrystalline diamond body of claim 1 wherein the metal diffusion—blocking layers comprise a metal or alloy of a metal taken from the group consisting of Mo, W, Zr, Ti, Nb, Ta, Cr and W.

9. The polycrystalline diamond body of claim 1 wherein the metal diamond body layers each have a thickness between 3–20 μm.

10. The polycrystalline diamond body of claim 1 wherein the topmost diamond layer has a lower binder metal content than the layer diamond layer to which it is bonded.

11. The polycrystalline diamond body of claim 4 wherein the low melting binder metal of each diamond layer is selected from the group consisting of Co, Ni, Fe, Mn, Si, Al, Mg, Cu and Sn.

12. The polycrystalline diamond body of claim 4 wherein the metal diffusion—blocking layers comprise a metal or alloy of a metal taken from the group consisting of Mo, W, Zr, Ti, Nb, Ta, Cr and V.

13. The polycrystalline diamond body of claim 4 wherein the metal diamond body layers each have a thickness between 3–20 μm.

14. The polycrystalline diamond body of claim 4 wherein the topmost diamond layer has a lower binder metal content than the layer diamond layer to which it is bonded.

15. The polycrystalline diamond body comprising the polycrystalline diamond body of claim 1 bonded onto a supporting disk by a metal diffusion—blocking intermediate layer.

16. The polycrystalline body of claim 15 wherein there are three diamond layers.

17. The polycrystalline body of claim 16 wherein the diamond layer outermost from the supporting disk has a lower metal content than the diamond layer bonded to the supporting disk.

18. The polycrystalline diamond body of claim 16 wherein the low melting binder metal of each diamond layer is selected from the group consisting of Co, Ni, Fe, Mn, Si, Al, Mg, Cu and Sn.

19. The polycrystalline diamond body of claim 16 wherein the metal diffusion—blocking layers comprise a metal or alloy of a metal taken from the group consisting of Mo, W, Zr, Ti, Nb, Ta, Cr and V.

20. The polycrystalline diamond body of claim 16 wherein the metal diamond body layers each have a thickness between 3–20 μm.

21. The polycrystalline diamond body of claim 16 wherein the topmost diamond layer has a lower binder metal content than the layer diamond layer to which it is bonded.

* * * * *

UNITED STATES PATENT AND TRADEMARK OFFICE

CERTIFICATE OF CORRECTION

PATENT NO. : 4,766,040

DATED : August 23, 1988

INVENTOR(S) : Hillert et al.

It is certified that error appears in the above-identified patent and that said Letters Patent is hereby corrected as shown below:

Column 1, line 68, "port" should read --porting--.

Column 2, line 33, "metal" should read --melting--.

line 46, "the" should read --The--.

Column 3, line 30, "not" should read --now--.

line 67, "resistance" should read --resistant--.

Column 5, line 55, "0.1·60" should read --0.1-60-- and "crystalline" should read --crystallites--.

line 60, after "ZrC," insert --WC--.

line 61, "SiC, TiN, Si3N4" should be removed from italics and read --SiC, TiN, $Si_3N_4$--.

Column 7, line 33, "1-50" should read --10-50--.

line 42 (line 1 of Claim 1), "resistance" should read --resistant--.

UNITED STATES PATENT AND TRADEMARK OFFICE

CERTIFICATE OF CORRECTION

PATENT NO. : 4,766,040

DATED : August 23, 1988

INVENTOR(S) : Hillert et al.

It is certified that error appears in the above-identified patent and that said Letters Patent is hereby corrected as shown below:

Column 8, line 16 (line 4 of claim 8), "W" should read --V--.

Signed and Sealed this

Eleventh Day of July, 1989

*Attest:*

DONALD J. QUIGG

*Attesting Officer*

*Commissioner of Patents and Trademarks*